United States Patent [19]

Loire

[11] Patent Number: 4,609,306

[45] Date of Patent: Sep. 2, 1986

[54] ICE-BREAKING OFF-SHORE DRILLING AND PRODUCTION STRUCTURE

[75] Inventor: René Loire, San Francisco, Calif.

[73] Assignee: Morrison-Knudsen Company, Inc., Boise, Id.

[21] Appl. No.: 525,688

[22] Filed: Aug. 23, 1983

[51] Int. Cl.[4] ..... E02B 17/00; B63B 35/08

[52] U.S. Cl. ..... 405/196; 405/201; 405/211; 405/217

[58] Field of Search ..... 405/61, 195, 201, 211, 405/217, 196; 114/40, 264

[56] References Cited

U.S. PATENT DOCUMENTS

| | | | |
|---|---|---|---|
| 4,102,144 | 7/1978 | Anders | 405/211 |
| 4,295,758 | 10/1981 | Yashima | 405/211 |
| 4,433,941 | 2/1984 | Gerwick et al. | 405/211 |
| 4,519,728 | 5/1985 | Oshima et al. | 405/217 X |

*Primary Examiner*—David H. Corbin

*Attorney, Agent, or Firm*—Walter J. Blenko, Jr.; Arnold B. Silverman

[57] ABSTRACT

An ice-breaking structure having a platform member adapted to be flexibly connected to an off-shore fixed well shaft in a manner which allows the platform to lift and/or tilt relative to the shaft is disclosed. The platform member has at least one lower surface which slopes upwardly toward an outer edge thereof and is adapted to be positioned on the shaft so that the sloping surface extends both above and below sea level. As oncoming ice approaches and contacts the structure, the sloping surface lifts a portion of the platform upwardly onto the ice so that part of the weight of the platform is carried by the ice. This weight on the ice aids in breaking-up the same. Various embodiments of the general concept are disclosed.

25 Claims, 8 Drawing Figures

ICE-BREAKING OFF-SHORE DRILLING AND PRODUCTION STRUCTURE

This invention relates to an off-shore structure having a platform member which is flexibly connected to a fixed well shaft. More specifically, a platform is connected to a shaft in a manner which will allow it to lift and/or tilt relative to the shaft thereby increasing the ice-breaking efficiency of the structure.

In connection with oil and gas drilling and production in pack-ice covered arctic seas, such as the Beaufort Sea, a number of ready-made structures, typically comprised of either steel or concrete, have been proposed. Some of those proposals contemplate fixed platforms having conically shaped base portions with circular sloping walls designed to lift and break pack-ice which drifts thereon. Other such platform structures have base portions presenting inverted cones or raked surfaces which intersect the water surface to sink and break the pack-ice striking such structures. All of those structures rely entirely on the kinetic energy of the flow of moving ice to provide the force necessary to break the ice upon contact with a rigidly anchored and fixed structure.

In a field unrelated to oil and gas production, that of ice-breaking ships, it is well known to provide a rake on the bow of a ship in order to lift the bow upwardly onto pack-ice as the ship moves into the ice. Part of the weight of the ship is carried by the ice which then breaks the ice downwardly. The ice-breaking ship relies primarily upon the kinetic energy of the ship to break the ice.

I provide an improved ice-breaking production and drilling structure having a platform member which is adapted to be flexibly connected to a fixed position off-shore well shaft and the line in a manner which will allow the platform to lift and/or tilt relative to the shaft.

I further provide a platform which has a lower surface thereon which slopes upwardly toward at least one outer edge thereof and adapted to be positioned on a fixed well shaft so that the sloping surface extends both above and below sea level. As the pack-ice drifts toward and contacts the structure at least one portion of the platform is lifted upwardly onto the ice by said sloping surface so that part of the platform's weight is carried by the ice. The weight of the platform on the ice aids in causing the ice to break up.

Where pack-ice is likely to drift onto the structure from a number of different directions, I prefer to provide either a structure which can be lifted upwardly from any direction or a structure which orients itself to rhe direction of oncoming ice.

Where the thickest ice features are likely to drift onto the structure from only a small angle sector, I prefer to provide a structure permanently oriented in that direction and which is designed to allow a greater portion of the platform's weight to lift upwardly onto the ice.

In some instances, I prefer to provide a platform which is ballasted with water to increase the weight thereof, whereas in other instances, I prefer to provide a floating or partially floating platform. I may provide a platform which is rotatably mounted to a fixed well shaft. I may further provide a platform which is pivotally mounted to a fixed well shaft. I may still further provide a platform having a surface sail and subsea fin thereon to aid in orienting the platform toward the flow of on coming ice.

In some instances, I prefer to provide a platform which has a generally circular top surface whereas in other instances, I prefer to provide platforms having more elongated top surface configurations.

In the accompanying drawings I have illustrated certain present preferred embodiments of my invention in which.

Figure 1:
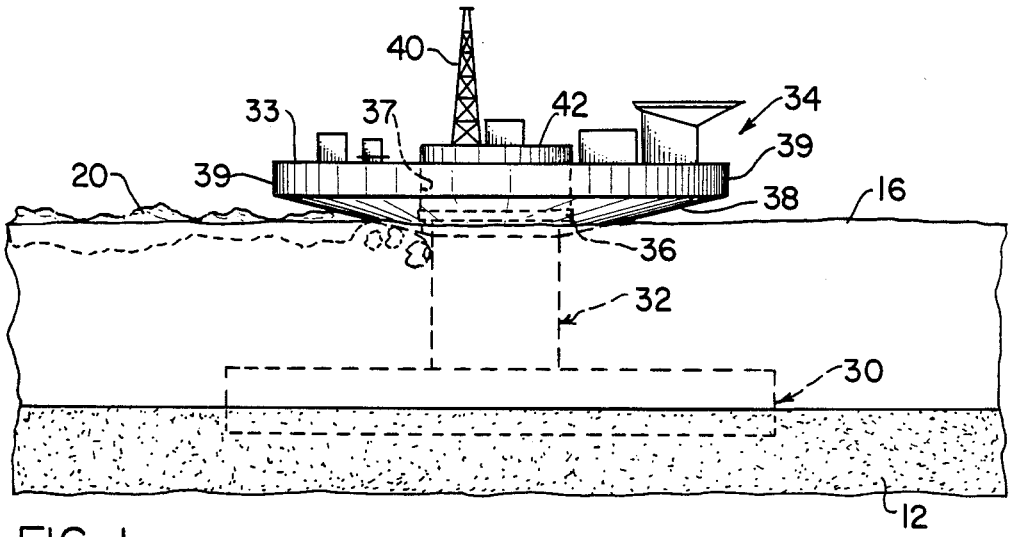
FIG. 1 is a side elevational view of a presently preferred embodiment of the invention showing an omni-directional ice-breaking super structure having an inverted conically shaped platform which intersects the water surface.

FIG. 1 shows an active omni-directional ice-breaking super structure according to the present invention. A fixed gravity base 30 embedded into the sea floor 12 provides a sufficent anchor for the structure. A well shaft 32 is fixed to base 30 and is provided with supporting brackets 36 or other suitable means for flexibly mounting or connecting a platform member 34. Platform 34 has a substantially flat upper surface 33 and an inverted conically shaped base portion 38 which intersects the sea surface 16 as shown. Supporting brackets 36 flexibly connect the platform 34 on fixed shaft 32 in a manner allowing the platform to lift and/or tilt relative to said shaft. Platform 34 has a bore 37 therein, preferably centered and sized larger than the well shaft 32 to allow the platform to lift and tilt with respect to shaft 32. Platform member 34 is preferably ballasted to make it as heavy as possible to provide greater ice-breaking potential. As an pack-ice 20 approaches the structure from any direction, the force of the ice causes the platform to tilt and lift upwardly onto the pack-ice. The weight of the structure on pack-ice 20 aids in the breaking thereof. Additionally, the sloping surface of the conical shaped bottom 38 of platform 34 forces the pack-ice 20 downwardly aiding in the breaking of the pack.

Typically, oil, gas, or injection water wells are provided within well shaft 32. These wells may be accessed through a derrick 40 which rests on the cellular deck 42 of well shaft 32.

Figure 2:
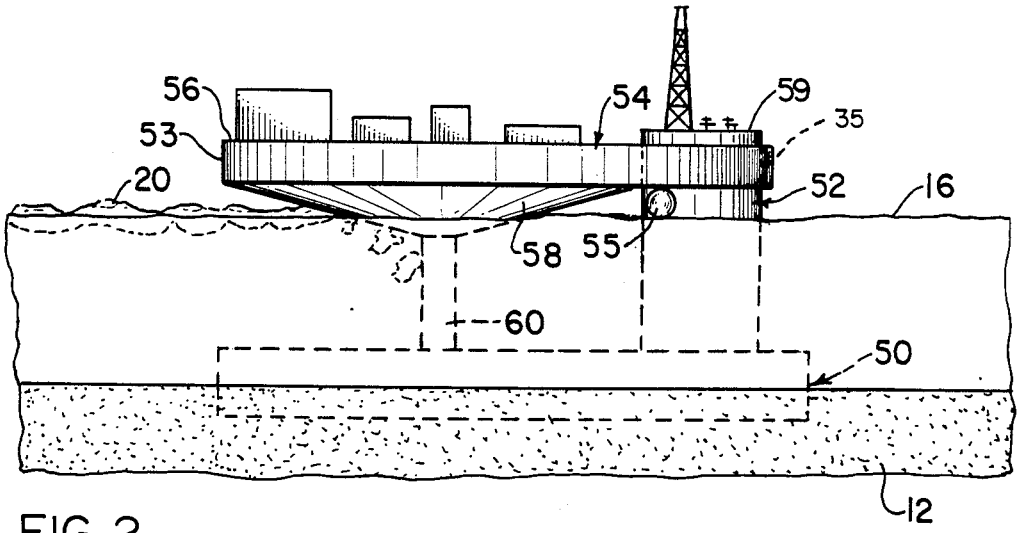
FIG. 2 is a side elevational view of another embodiment of the invention showing a single directional ice-breaking super structure having a platform pivotally mounted at one end to a fixed off-shore well shaft and supported by a slim column when not lifted by the ice.

FIG. 2 shows a single directional ice-breaking super structure. This structure has a fixed foundation 50 and fixed well shaft 52 attached thereto. A platform member 54 is pivotally mounted to the well shaft 52 by pivot 55 as shown. Well shaft 52 extends upwardly through a bore 35 provided in one end of the platform 54. The platform has a substantially flat upper surface 56 and inverted conically shaped lower surface 58 which extends both above and below sea level 16. The bottom portion 58 of platform 54 rests on a super structure rest or column 60 when not lifted upwardly by ice flow 20. As ice flow 20 moves towards end 53 of platform 54, end 53 is lifted upwardly by the oncoming ice flow from the column 60. The weight of the ballasted platform together with the wedge like action of the sloping lower surface 58 causes the ice flow to break. In the event that the ice flow does not have sufficient force to lift platform 54 upwardly about pivot 55, column 60 also serves to break-up ice passing beneath the platform.

Figure 3:
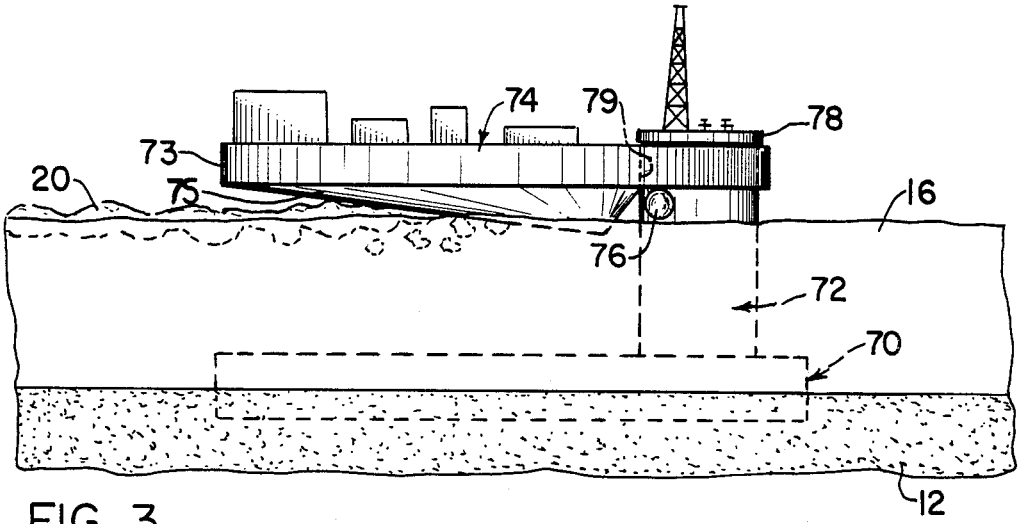
FIG. 3 is a side elevational view of yet another embodiment of the invention showing a super structure having a pivotally mounted platform entirely supported by a fixed well shaft.

FIG. 3 shows a super structure having a base 70, a fixed well shaft 72 extending upwardly therefrom and a platform member 74 pivotally mounted on the upper end of the well shaft 72 about pivot 76. Well shaft 72 extends through platform bore 79 as shown. A stop 78 is provided on the top portion of well shaft 72 to prevent the platform 74 from tipping downwardly, thereby eliminating the need for a substructure rest or column as described above. As the pack-ice 20 approaches end 73 of the platform 74, end 73 is lifted upwardly onto the pack and the wedge action of sloped surface 75 together with the weight of the platform act to break up the ice.

Figure 4:
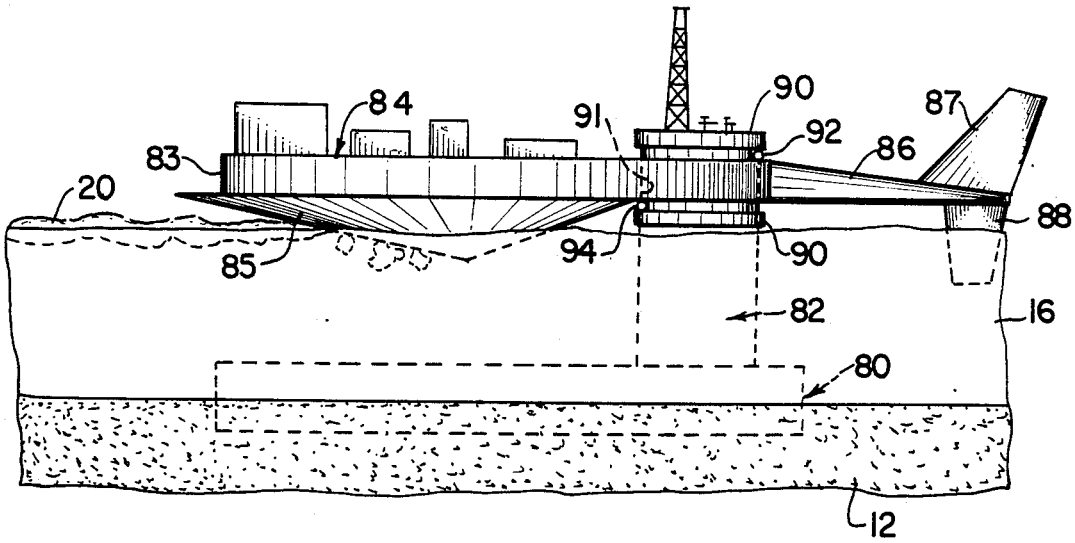
FIG. 4 is a side elevational view of still another embodiment of the invention showing a super structure having an elongated platform, one end of which having a sail and a subsea fin thereon for orienting the platform toward the ice flow.

FIG. 4 shows a structure in which a gravity base 80 having a well shaft 82 rigidly mounted thereto is embedded into the sea floor 12. A platform member 84 is flexibly and rotatably mounted to well shaft 82 through platform bore 91 and is supported between two annular ring members 90 as shown. An upper bearing 92 and lower bearing 94 allow the platform to rotate without preventing end 83 of platform 84 from lifting upwardly. Platform 84 is provided with a tail portion 86 having a dorsal fin or sail 87 extending upwardly therefrom and a ventral fin or subsea fin 88 extending downwardly beneath sea level 16. Sail 87 under the force of wind and fin 88 under the force of the sea current aid in orienting the platform member on said shaft in a manner so that end 83 faces the direction of an oncoming ice flow or pack 20. As the ice flow 20 contacts the front end portion 83 of the platform, end 83 is lifted upwardly and the rake or sloped lower surface 85 of platform 84, which intersects sea surface 16, together with the weight of the platform act to break-up the ice flow.

Figure 5:
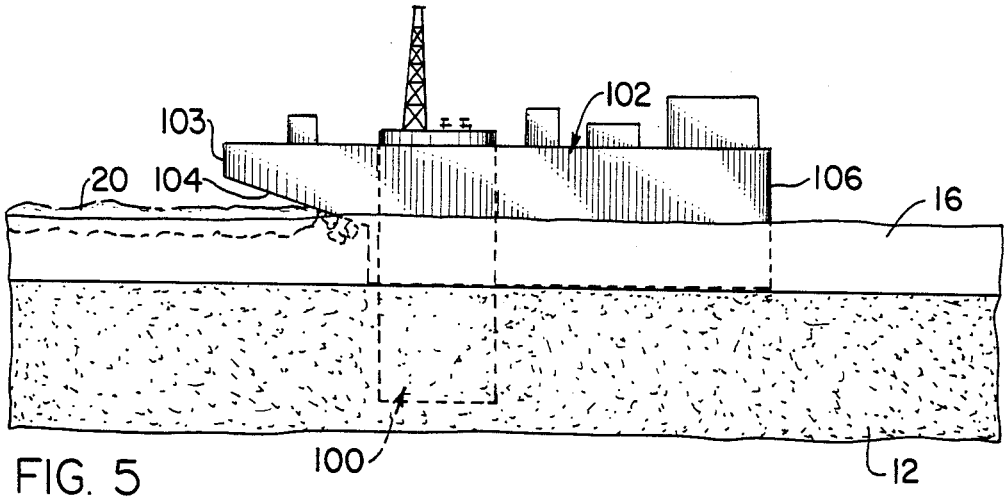
FIG. 5 is an side elevational view of yet another embodiment of the present invention showing a super structure for use in shallow water having a platform rotatably mounted to a fixed well shaft.
Figure 6:
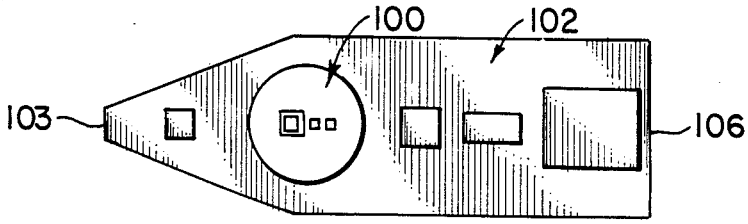
FIG. 6 is a top plan view of the structure shown in FIG. 5.

FIGS. 5 and 6 illustrate a structure for use in relatively shallow water. A well shaft 100 is embedded directly into the ocean floor 12. Rotatably attached to well shaft 100 is a flexibly coupled platform member 102 having a front end 103 which has a lower sloping surface 104 which serves to break up oncoming ice 120 in the manner described above. The opposite end 106 of platform 102 extends to and partially rests on sea floor 12 and is directed downstream by the force of the sea current causing end 103 to orient itself towards the oncoming ice flow, provided said current is sufficient to overcome the friction of platform member 102 on sea floor 12. With this configuration, it is necessary to drive or sink the well shaft 100, or a bundle of piles very deeply into the sea floor 12, which in some cases, may present some difficulties. Therefore, in some cases, the arrangement shown in FIG. 7 may be preferred.

Figure 7:
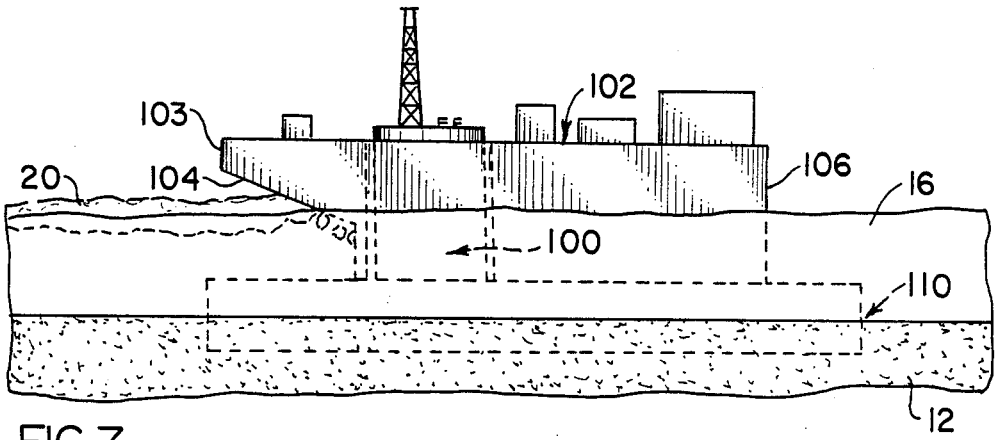
FIG. 7 is a side elevational view of yet another embodiment of the invention showing a modified version of the structure shown in FIG. 5 for use with a shaft having a fixed gravity base.

The structure shown in FIG. 7 is substantially the same as that described in FIGS. 5 and 6 except that a fixed gravity base 110 is embedded into the sea floor 12 rather than directly embedding the column 100.

Figure 8:
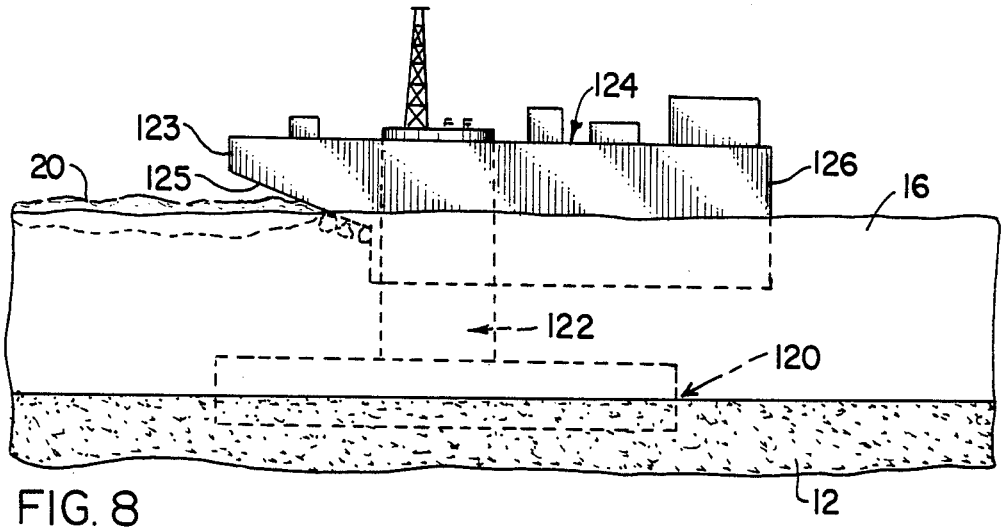
FIG. 8 is a side elevational view of still another embodiment of the invention showing a super structure having a floating platform rotatably mounted to a fixed well shaft.

FIG. 8 illustrates a buoyant weathervane like ice-breaking super structure. A fixed column 122 either driven into the soil or cantilevering from gravity base 120 provides mounting means for a flexibly and rotatably mounted floating platform member 124. End 126 of platform 124 extends beneath sea level 16 and, together with the ocean current, provides a means for orienting the opposite end 123 towards the oncoming ice flow 20. Sloping surface 125 intersects the sea level 16 and provides a means for breaking up the ice flow.

In each of the above described embodiments of the present invention, a platform is flexibly connected to a fixed well shaft in a manner which allows the platform to lift and/or tilt with respect to the shaft. The platform, in each case, has at least one lower surface which slopes upwardly toward an outer edge of the platform and is positioned on the shaft so that said sloping surface extends both above and below sea level. In certain embodiments of the invention, I provide ballasted platforms to increase the weight thereof. In other embodiments, floating or partially floating platforms are utilized. In all cases, the off-shore drilling and production structures according to the present invention provide greatly increased ice-breaking efficiency over the fixed structures which are presently known and used.

While I have illustrated and described certain present preferred embodiments of the invention it is to be understood that the invention is not limited thereto and may be otherwise variously practiced within the scope of the following claims.

I claim:

1. An ice-breaking drilling and production structure for use with an off-shore vertically disposed well shaft and the like having one end extending dowardly toward a sea floor and having an opposite end extending upwardly to a point above sea level, said structure comprising:

(a) a platform member having outer edges and a generally downwardly facing lower surface which slopes upwardly toward at least one outer edge thereof and adapted to be positioned on a shaft so that the sloping surface extends both above and below sea level; and (b) means for flexibly connecting the platform to a shaft in a manner which will allow the platform to lift and/or to tilt with respect to the shaft as ice moves under the sloping generally downwardly facing lower surface to transfer part of the weight of the platform to the ice and thereby break the same.

2. An improved ice-breaking drill and production structure for use with an off-shore vertically disposed well shaft and the like having one end thereof extending downwardly toward a sea floor and having an opposite end extending upwardly to a point above sea level of the type comprising a platform member having at least one sloping generally downwardly facing surface and attaching means for attaching the platform to an off-shore shaft in a position so that the sloping surface extends both above and below sea level wherein the improvement comprises:

(a) a platform adapted to be flexibly connected to an off-shore shaft; and (b) connecting means for flexibly connecting the platform to an off-shore shaft in a manner which will allow the platform to lift and/or tilt with respect to the shaft as ice moves under the sloping generally downwardly facing lower surface to transfer part of the weight of the platform to the ice and thereby break the same.

3. An ice-breaking drilling and production structure comprising:

(a) a vertically disposed well shaft having one end thereof extending downwardly toward a sea floor and having an opposite end extending upwardly to a point above sea level;

(b) a platform member having outer edges and a lower generally downwardly facing surface whichslopes upwardly toward at least one outer edge thereof and positioned on the shaft so that the sloping surface extends both above and below sea level; and (c) means for flexibly connecting the platform to the shaft in a manner which will allow the platform to lift and/or tilt with respect to the shaft as ice moves under the sloping generally downwardly facing lower surface to transfer part of the weight of the platform to the ice and thereby break the same.

4. A structure according to claim 1 wherein said platform has a bore therein sized at least large enough to receive the shaft.

5. A structure according to claim 2 wherein said platform has a bore therein sized at least large enough to receive the shaft.

6. A structure according to claim 1 wherein the off-shore shaft is cylindrical.

7. A structure according to claim 2 wherein the off-shore shaft is cylindrical.

8. A structure according to claim 1 wherein the platform has a substantially flat upper surface positioned above sea level.

9. A structure according to claim 2 wherein the platform has a substantially flat upper surface positioned above sea level.

10. A structure according to claim 4 wherein the platform is generally circular in shape and the bore is provided substantially in the center thereof.

11. A structure according to claim 5 wherein the platform is generally circular in shape and the bore is provided substantially in the center thereof.

12. A structure according to claim 10 wherein the lower platform surface has generally an inverted cone shaped configuration.

13. A structure according to claim 11 wherein the lower platform surface has generally an inverted cone shaped configuration.

14. A structure according to claim 4 wherein the bore is provided near an outer edge of the platform and the connecting means is a pivot.

15. A structure according to claim 5 wherein the bore is provided near an outer edge of the platform and the connecting means is a pivot.

16. A structure according to claim 1 wherein the platform is ballasted to increase the weight thereof.

17. A structure according to claim 2 wherein the platform is ballasted to increase the weight thereof.

18. A structure according to claim 14 wherein said platform has a downwardly extending vertical column member fixed thereto and positioned to prevent the platform from tipping downwardly about said pivot beyond a desired point.

19. A structure according to claim 15 wherein said platform has a downwardly extending vertical column member fixed thereto and positioned to prevent the platform from tipping downwardly about said pivot beyond a desired point.

20. A structure according to claim 1 wherein the platform is rotatably mounted to the shaft.

21. A structure according to claim 2 wherein the platform is rotatably mounted to the shaft.

22. A structure according to claim 20 further comprising means for rotating the platform so that the sloping lower surface faces an oncoming flow of ice.

23. A structure according to claim 21 further comprising means for rotating the platform so that the sloping lower surface faces an oncoming flow of ice.

24. A structure according to claim 22 wherein the rotating means is a surface and subsea fin attached to one end of the platform.

25. A structure according to claim 23 wherein the rotating means is a surface and subsea fin attached to one end of the platform.

* * * * *

UNITED STATES PATENT AND TRADEMARK OFFICE

CERTIFICATE OF CORRECTION

PATENT NO. : 4,609,306

DATED : September 2, 1986

INVENTOR(S) : Rene Loire

It is certified that error appears in the above-identified patent and that said Letters Patent is hereby corrected as shown below:

Column 1, line 52, "rhe" should be --the--;

Column 4, line 41, "dowardly" should be --downwardly--;

Column 5, line 18, "whichslopes" should be --which slopes--.

Signed and Sealed this

Fourth Day of November, 1986

[SEAL]

*Attest:*

DONALD J. QUIGG

*Attesting Officer*

*Commissioner of Patents and Trademarks*